United States Patent [19]

Tornberg

[11] Patent Number: 4,965,043

[45] Date of Patent: Oct. 23, 1990

[54] METHOD OF POWDER-METALLURGICAL PRODUCTION OF OBJECTS, SPECIFICALLY OF TUBES, RODS, OR THE LIKE

[75] Inventor: Claes Tornberg, Höganäs, Sweden

[73] Assignee: Avesta Nyby Powder AB, Sweden

[21] Appl. No.: 328,584

[22] PCT Filed: May 19, 1988

[86] PCT No.: PCT/EP88/00443

§ 371 Date: Jan. 23, 1989

§ 102(e) Date: Jan. 23, 1989

[87] PCT Pub. No.: WO88/09235

PCT Pub. Date: Dec. 1, 1988

[30] Foreign Application Priority Data

May 21, 1987 [DE] Fed. Rep. of Germany ..... 3717154

[51] Int. Cl.[5] ..... B22F 7/00

[52] U.S. Cl. ..... 419/8; 419/48; 419/58; 419/68; 419/67

[58] Field of Search ..... 419/48, 58, 68, 67; 75/245

[56] References Cited

U.S. PATENT DOCUMENTS

| | | | |
|---|---|---|---|
| 3,893,852 | 8/1975 | Bergman et al. | 419/49 |
| 3,893,852 | 7/1975 | Bergman et al. | 75/224 |
| 3,931,382 | 1/1976 | Witkin | 264/88 |
| 4,094,709 | 6/1978 | Rozmus | 148/126 |
| 4,233,720 | 11/1980 | Rozmus | 29/407 |
| 4,364,162 | 12/1982 | Nilsson et al. | 419/26 |
| 4,401,723 | 8/1983 | Aslund et al. | 428/554 |
| 4,729,730 | 3/1988 | Hatayama et al. | 425/405.2 |

FOREIGN PATENT DOCUMENTS 2097022 10/1982 United Kingdom .

*Primary Examiner*—Brooks H. Hunt
*Assistant Examiner*—Ngoulant Mai
*Attorney, Agent, or Firm*—Andrus, Sceales, Starke & Sawall

[57] ABSTRACT

A method of powder-metallurgical production of objects, specifically tubes, rods, or the like, wherein a metal and/or metal alloy powder is charged into a thin-walled capsule is provided. The capsule is closed and exposed to a cold-isostatic pressure so as to form a compression of the capsule for subsequent hot-working, specifically hot extrusion. Prior to the cold-isostatic pressure, a mixture of nitrogen and hydrogen is introduced into the capsule together with the powder of metal and/or metal alloys. Simultaneously, pre-compaction of the powder is created by way of vibration or the like, to a density of approximately 60 t0 80% such as, in particular 70% of the theoretical density. After the cold-isostatic pressing step, the capsule is subjected to porosity or leakage testing in a vacuum chamber to monitor or establish the escape of hydrogen. Non-leaking capsules or pressings are then heated and subjected to hot-working such as hot extrusion.

8 Claims, No Drawings

METHOD OF POWDER-METALLURGICAL PRODUCTION OF OBJECTS, SPECIFICALLY OF TUBES, RODS, OR THE LIKE

BACKGROUND OF THE INVENTION

The present invention relates to a method of powder-metallurgical production of objects, specifically tubes, rods, or the like, in accordance with introduction of a gaseous mixture of nitrogen and hydrogen with a metal powder into a sealed capsule for cold-isotatic pressure prior to hot working.

The objects to be manufactured should consist particularly of stainless steel or high-alloyed nickel steel with good high-temperature characteristics, such as steels containing some 80% of nickel and 20% of chromium. The objects to be produced may, however, also consist of high-speed steels or any other metals and/or metal alloys. The capsules for use in production of these objects are made of a thin metal sheet having a gauge in the range of 1 to 2 mm. For a leakage test of the capsules it has been proposed to introduce helium into the capsule (see German Patent 31 15 095). When this test proved a sufficient sealinig the capsule was charged with a powder of metal and/or metal alloys, then closed and exposed to a cold-isostatic pressure for subsequent hot-working. This type of leakage test, however, has shown that one part of the introduced helium remains in the capsule, in spite of previous flushing with nitrogen or a similar gas, specifically when the capsules are comparatively long and tubular and have a narrow annular gap at one end. Moreover, the diffusion of the enclosed helium gas out of the closed capsule requires a very long time. With a major helium volume inside the capsule the manufactured product tends to become brittle, which is obviously due to occluded helium. Apart from that, the aforementioned method does not allow for leakage testing of the charged and closed capsule, which results in the consequence that the closed capsule may well still present a certain degree of porosity, in particular in the area of the closed powder-charging opening. Thus there is the risk of water penetrating into the capsule during the cold-isostatic pressing step, which leads to actual explosion of the capsule in the subsequent heating step.

The present invention is based on the problem of eliminating the safety risk mentioned last, and, in particular, of obtaining top quality products (with increased homogeneity, improved strength and uniform surface quality, as well as lack of brittleness).

SUMMARY OF THE INVENTION

The present invention solves the problem discussed above.

The present invention is directed to a method of powder-metallurgical production of objects such as tubes, rods or the like which includes charging a thin-walled capsule with a metal powder selected from a metal and/or a metal alloy. The capsule is closed and exposed to a cold-isostatic pressure so as to form a pressing for subsequent hot-working such as hot extrusion.

In accordance with the present invention, a nitrogen and hydrogen gas mixture is introduced into the capsule together with the metal powder and simultaneously pre-compacts the powder to about a density of 60 to 80% of the theoretical density and preferably to about 70%. The gas mixture generally includes 70 to 95% of nitrogen and 30 to 5% hydrogen, and in one preferred process about 80% of nitrogen and 20% of hydrogen and in another about 90% of nitrogen and 10% of hydrogen. The pre-compacted capsule is subjected to the cold-isostatic pressure for compaction up to about 95% of the theoretical density. The capsule is then tested for leakage in a vacuum chamber prior to the heating and hot-working.

In a particular application, the metal powder is selected from the group of stainless steel, high-alloyed nickel steels and the like which have good high-temperature characteristics. The metal powder preferably contains about 80% of nickel and about 20% of chromium or high-speed steels. The capsule may consist of carbon steel with a carbon percentage less than 0.004%.

By contrast to the known proposal, the present invention provides for a porosity or leakage test performed on the finished capsule after the cold-isostatic pressing step or on the pressing itself so that the aforementioned safety risk will be entirely eliminated.

The nitrogen introduced into the capsule reacts with the powder material and/or the capsule, forming an alloying constituent of the finished product. When the capsule, after cold-isostatic pressing is heated, the introduced hydrogen easily diffuses through the wall of the capsules unless it will have leaked out previously. In such a case, however, the capsule ought to be singled out since hot-working would lead to cracking in the area of the porous or leaking locations. One part of the introduced hydrogen is also dissolved by the carbon steel of the capsule itself so that with a definitely tight capsule the introduced gas mixture will not cause any problems in terms of processing.

DESCRIPTION OF THE EMBODIMENT

The present invention is described in manufacture of tubes, rods and the like elongated members, particularly of stainless steel or high-alloyed nickel steel with good high-temperature characteristics, the steels contain some 80% of nickel and 20% of chromium. The elongated object or member may, however, also consist of high-speed steels or any other metals and/or metal alloys. The objects are formed from a powdered metal confined within a capsule. The capsule for use in production of these objects is made of a thin metal sheet having a gauge in the range of 1 to 2 mm. The capsule is then charged with the metal powder of metal and/or metal alloys and special gas mixture. The filled capsule is closed and exposed to a cold-isostatic pressure.

According to the present invention, the gas mixture consists of nitrogen 70 to 95% of ($N_2$) and 30 to 5% of hydrogen ($H_2$) preferably 90% of $N_2$ and 10% of $H_2$, is introduced into the capsule together with the powder composed of metal and/or metal alloys. Then the capsule is subjected to a cold-isostatic pressing procedure so as to achieve compaction to 60 to 95%, specifically 65 to 93%, of the theoretical density and, exerting a pressure of 4000 bar at minimum, which is particularly in the range from 4200 to 6000 bar and preferably in the range of about some 4500 to 5000 bar.

Before the capsule is closed, it is preferably subjected to pre-compaction by vibration at some 80 to 100 cps so as to achieve a density corresponding to some 60 to 75%, particularly and preferably about or some 71%, of the theoretical density.

After the cold-isostatic pressing, the pressed capsule or the corresponding pressing is then heated for subsequent hot-working, in particular hot extrusion, so as to produce the desired elongate object, e.g. a tube, rod, section, or the like. In accordance with the present invention, following the cold-isostatic capsule-pressing step, a leakage or porosity test is performed in a vacuum chamber so as to determine whether or not the $H_2$ gas introduced into the capsule will escape.

At the same time, the introduced gas mixture results in a marked improvement of the quality of the finished product. The risk of the object becoming brittle is practically entirely eliminated. The homogeneity of the material is improved. The same applies to the strength. Moreover, a more uniform surface quality is achieved. These advantages can be recognized particularly when comparatively long and thin-walled tubes are produced from correspondingly dimensioned capsules, e.g. tubular capsules whose axial length/inside diameter ratio exceeds 5:1, specifically 10:1.

The method according to the present invention is less expensive than the known method, in terms of both space requirement and necessary installations. Moreover, the method according to the present invention consumes substantially less time.

I claim:

1. A method of powder-metallurgical production of objects, specifically tubes, rods, or the like, wherein a metal powder including powders selected from a metal and/or a metal alloy is charged into a thin-walled capsule, said capsule wall being formed of material including carbon steel, the capsule is then closed and exposed to a cold-isostatic pressure so as to form a pressing for subsequent hot-working, specifically hot extrustion, comprising the improvement including introducing a nitrogen and hydrogen gas mixture into the capsule together with said metal powder simultaneously pre-compacting said powder to about a density of 60 to 80% of the theoretical density, closing the capsule, and subjecting said pre-compacted capsule to a cold-isostatic pressure for compaction up to about 95% of the theoretical density, and testing said compacted capsule for leakage of hydrogen in a a vacuum chamber prior to heating and hot-working.

2. The method of claim 1 wherein said pre-compacting is to substantially 70% of the theoretical density.

3. The method according to claim 1 wherein said metal includes a powder selected from the group of stainless steel, high-alloyed nickel steels and the like with good high-temperature characteristics.

4. The method according to claim 3 wherein said metal contains about 80% of nickel and about 20% of chromium.

5. The method according to claim 1 or 3 wherein said capsule consists of carbon steel with a carbon percentage less than 0.004%.

6. A method according to claim 1 or 3 wherein said gas mixture includes 70 to 95% of nitrogen and 30 to 5% hydrogen.

7. The method according to claim 1 or 3 wherein said gas mixture includes about 80% of nitrogen and 20% of hydrogen.

8. The method according to claim 1 or 3 wherein said gas mixture includes about 90% of nitrogen and 10% of hydrogen.

* * * * *

UNITED STATES PATENT AND TRADEMARK OFFICE

CERTIFICATE OF CORRECTION

PATENT NO. : 4,965,043

DATED : October 23, 1990

INVENTOR(S) : CLAES TORNBERG

It is certified that error appears in the above-identified patent and that said Letters Patent is hereby corrected as shown below:

In the references, cancel "3,89 3,852, 8/1975, Bergman et al";

In the claims, Claim 1, column 4, line 10, delete second occurrence of "a".

Signed and Sealed this

Nineteenth Day of May, 1992

*Attest:*

DOUGLAS B. COMER

*Attesting Officer*

*Acting Commissioner of Patents and Trademarks*